US008007340B2

(12) United States Patent
Sip

(10) Patent No.: US 8,007,340 B2
(45) Date of Patent: Aug. 30, 2011

(54) ARTIFICAL EYE STRUCTURE AND TOY HAVING SAME

(75) Inventor: Kim-Yeung Sip, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 102 days.

(21) Appl. No.: 12/491,249

(22) Filed: Jun. 25, 2009

(65) Prior Publication Data

US 2010/0291832 A1 Nov. 18, 2010

(30) Foreign Application Priority Data

May 18, 2009 (CN) ..... 2009 1 0302412

(51) Int. Cl.
*A63H 3/48* (2006.01)

(52) U.S. Cl. ..... 446/392; 446/236; 446/337; 446/339; 446/340; 446/341; 446/342; 446/343; 446/344; 446/345; 446/346; 446/347; 446/348; 446/349; 446/350; 446/351; 446/389; 446/390; 446/391; 446/393; 446/395; 446/396; 434/271

(58) Field of Classification Search ..... 446/392, 446/236, 337, 339–351, 389–391, 393, 395–396; 434/271

See application file for complete search history.

(56) References Cited

U.S. PATENT DOCUMENTS

| | | | | |
|---|---|---|---|---|
| 3,660,932 | A * | 5/1972 | Raffeli et al. | 446/346 |
| 5,399,115 | A * | 3/1995 | Arad et al. | 446/342 |
| 5,681,040 | A * | 10/1997 | Peterson | 273/148 R |
| 6,905,390 | B2 * | 6/2005 | Fukui et al. | 446/337 |
| 2006/0099880 | A1 * | 5/2006 | Laurienzo et al. | 446/247 |

* cited by examiner

*Primary Examiner* — Gene Kim
*Assistant Examiner* — Amir Klayman
(74) *Attorney, Agent, or Firm* — Frank R. Niranjan

(57) ABSTRACT

An artificial eye structure rotates an artificial upper eyelid via the attraction between a number of electromagnetic elements disposed in a line and a magnet. The rotation angle of the artificial upper eyelid can be controlled by selectively magnetizing the electromagnetic elements.

11 Claims, 5 Drawing Sheets

ARTIFICAL EYE STRUCTURE AND TOY HAVING SAME

BACKGROUND

1. Technical Field

The present disclosure relates to artificial eye structures and, particularly, to an artificial eye structure capable of controlling a rotation angle of an artificial upper eyelid thereof.

2. Description of Related Art

Currently, an artificial eye structure for use in a toy/robot typically can rotate eyelids thereof to enhance authenticity of simulated behavior. The eyelids are generally driven to rotate by an electric motor which is noisy and easily damaged. On the other hand, driven by the electric motor, the eyelids are typically kept at either an open state or a close state. Reality of simulated behavior is somehow compromised.

What is needed, therefore, is an artificial eye structure which can overcome the above-mentioned problems.

BRIEF DESCRIPTION OF THE DRAWINGS

Many aspects of the present embodiments can be understood with reference to the figures. The components in the figures are not necessarily drawn to scale, the emphasis instead being placed upon clearly illustrating the principles of the present embodiments. Moreover, in the figures, like reference numerals designate corresponding parts throughout the several views.

DETAILED DESCRIPTION

Figure 1:
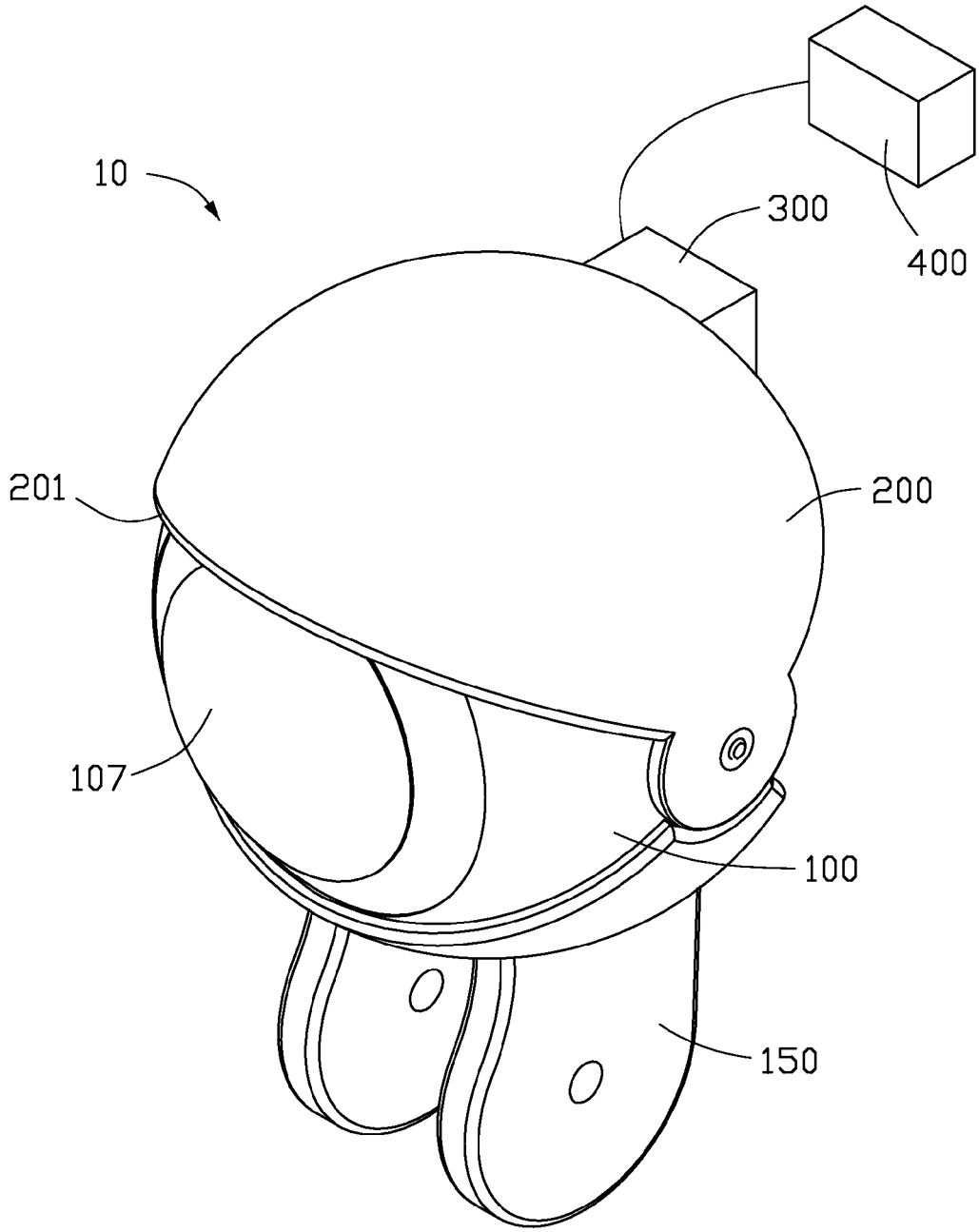
FIG. 1 is an assembled, isometric, schematic view of an exemplary embodiment of an artificial eye structure.
Figure 2:
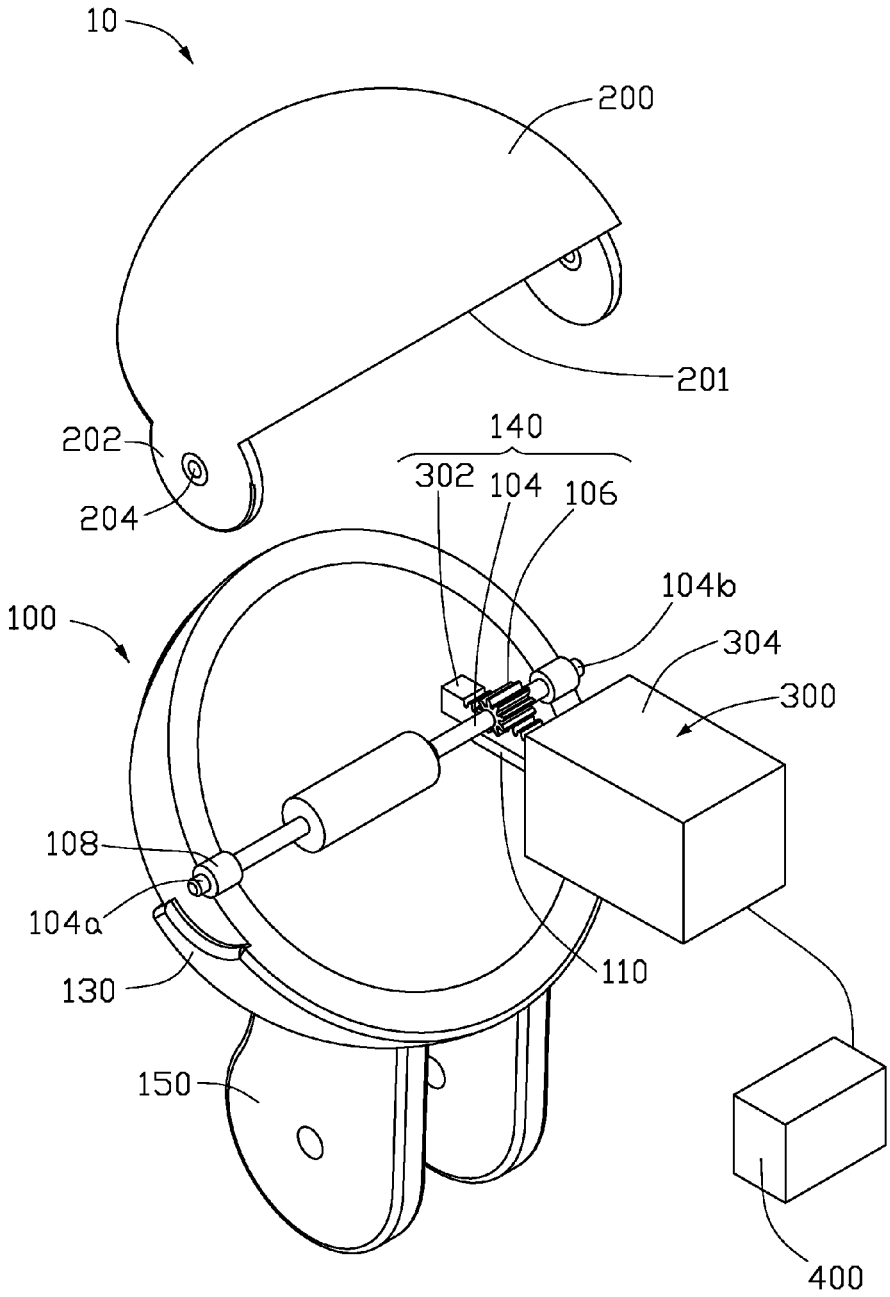
FIG. 2 is an exploded, isometric, schematic view of the artificial eye structure of FIG. 1, viewed at another angle.

Referring to FIG. 1 and FIG. 2, an artificial eye structure 10 for use in a toy or robot 500 (see FIG. 5) in accordance with an exemplary embodiment is illustrated. The toy or robot 500 employs a battery 500*a* (see FIG. 5) for power supply. The artificial eye structure 10 includes an artificial eyeball 100, an artificial upper eyelid 200, an artificial lower eyelid 130, a support portion 150, a transmission device 140, a drive device 300, a spring 306 (see FIG. 4), and a controller 400.

Figure 3:
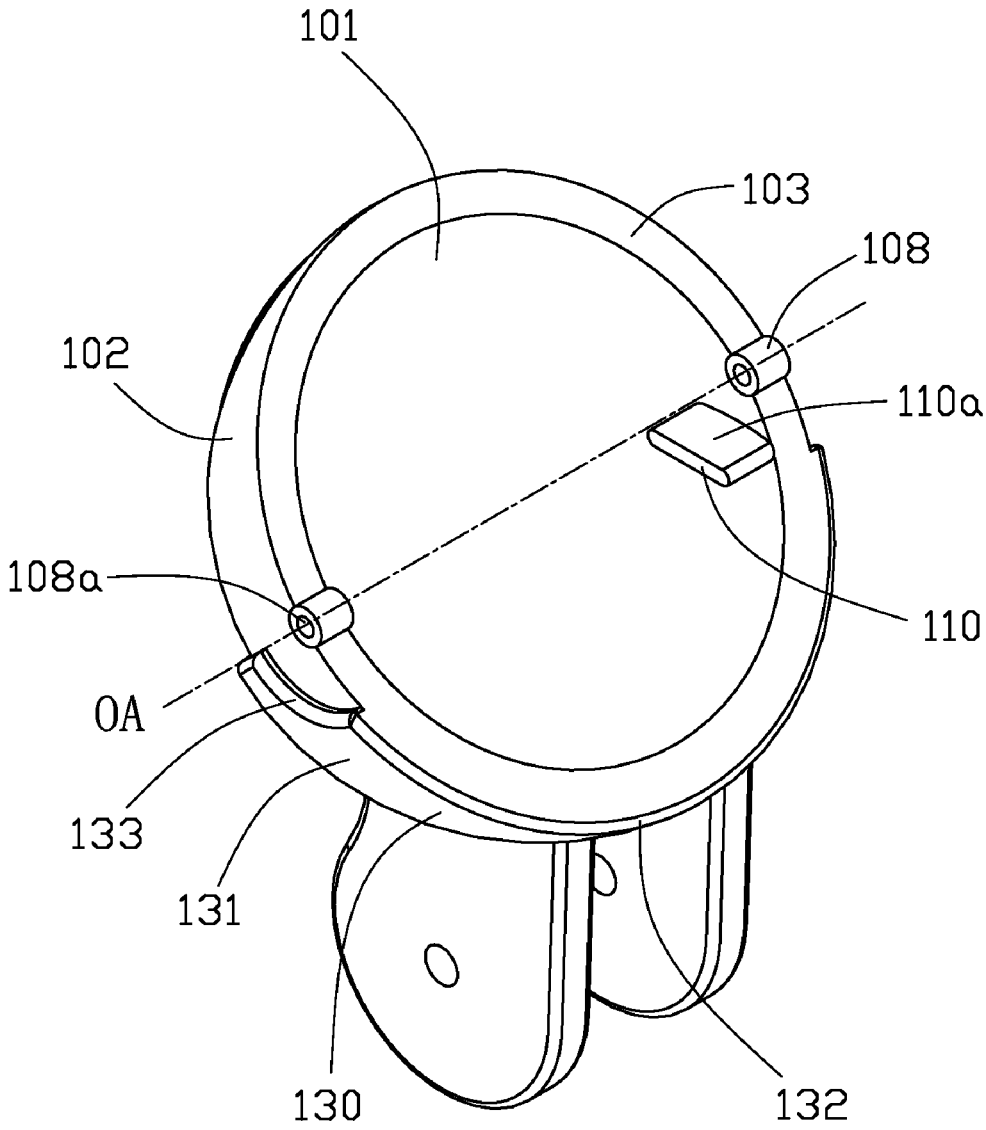
FIG. 3 is an isometric, schematic view of an artificial eyeball of the artificial eye structure of FIG. 1.

Also referring to the FIG. 3, the artificial eyeball 100 is substantially a hollow semi-sphere and includes a first inner surface 101, a first outer surface 102, an edge 103, a pair of shaft sleeves 108, and a sliding support 110. The edge 103 is circular. The shaft sleeves 108 are formed at the edge 103. Each of the shaft sleeves 108 is generally a cylinder and defines a pivot hole 108*a* therethrough. The pivot holes 108*a* are aligned with each other and define a pivot axis OA substantially passing a diameter of the circular edge 103. A pupil pattern 107 is formed generally on the middle of the first outer surface 102. The sliding support 110 is a plate extending from the inner surface 101 beneath the shaft sleeve 108. The sliding support 110 includes a holding surface 110*a* parallel to the pivot axis OA.

The artificial upper eyelid 200 is substantially a quarter of hollow sphere and includes a pair of circular edges 201, and a pair of connecting ears 202. The connecting ears 202 are circular plates correspondingly extend from two intersections of the circular edges 201. The connecting ears 202 correspondingly define two through holes 204 in the corresponding centers thereof. The two through holes 204 are aligned with each other. The radius of the artificial upper eyelid 200 is a little larger than that of the artificial eyeball 100.

The artificial lower eyelid 130 is substantially similar to the artificial upper eyelid 200 in shape and includes a second outer surface 131, a pair of long circular edges 132, and a pair of short circular edges 133. The short circular edges 133 are correspondingly formed at the intersections of the long circular edges 132. The radius of short circular edge 133 is substantially equal to that of the connection ears 202. The support portion 150 includes a pair of plates parallel to each other. The plates substantially extend perpendicularly from the second outer surface 131. The support portion 150 is configured to fix the artificial eye structure 10 to the toy/robot 500.

The transmission device 140 includes a shaft 104, a gear 106, and a transmission rod 302. The shaft 104 includes two opposite connecting ends 104*a*, 104*b*. The gear 106 is sleeved on the shaft 104.

Figure 4:
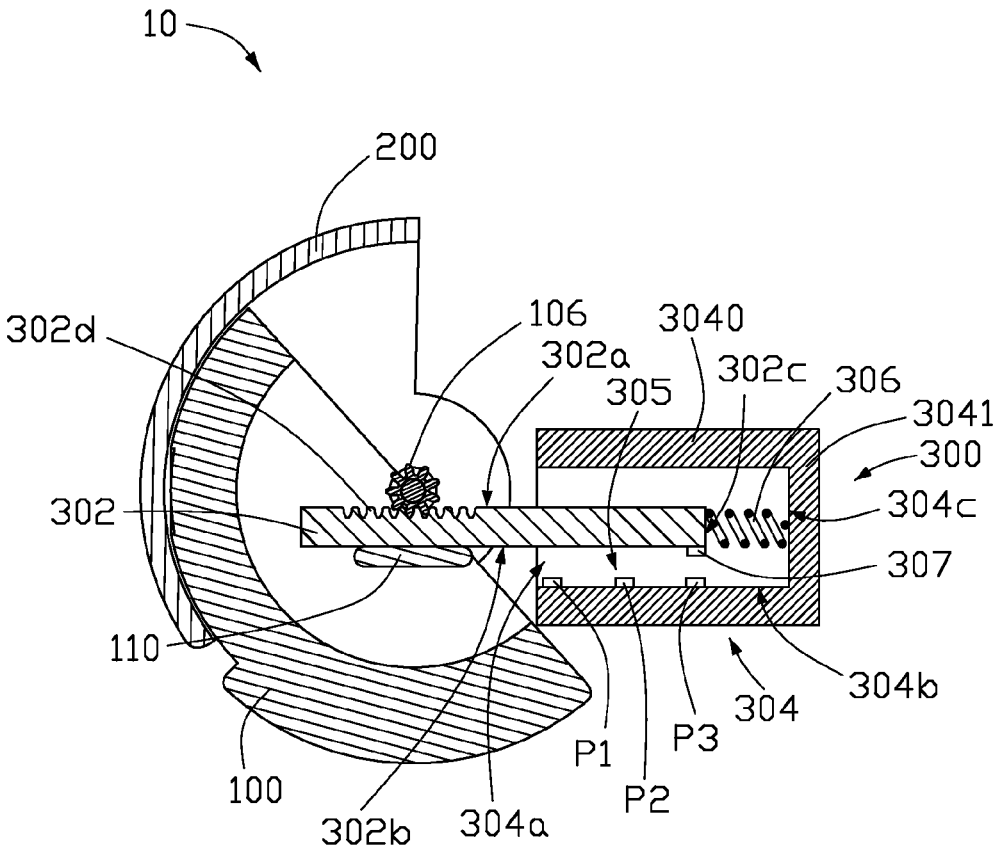
FIG. 4 is a cross-sectional, schematic view of the artificial eye structure of FIG. 1.

Also referring to FIG. 4, the transmission rod 302 is an elongated block and includes an upper surface 302*a*, a bottom surface 302*b* opposite to the upper surface 302*a*, and an end surface 302*c*. The upper surface 302*a* defines a toothed rack section 302*d* thereon to engage the gear 106. The end surface 302*c* connects the upper surface 302*a* and the bottom surface 302*b*.

The drive device 300 includes a container 304, a number of electromagnetic elements 305, and a permanent magnet 307. The container 304 includes a rectangular tube 3040 and an end wall 3041 sealing one end of the rectangular tube 3040. The rectangular tube 3040 includes an inner bottom surface 304*b*. The end wall 3041 includes a second inner surface 304*c* substantially perpendicular to the inner bottom surface 304*b*. The electromagnetic elements 305 are disposed on the inner bottom surface 304*b* substantially along the longitudinal direction of the rectangular tube 3040 from the second inner surface 304*c* to the end of the rectangular tube away form the end wall 3041. The positions of electromagnetic elements 305 are denoted as P1 to PN, where PN is adjacent to the end wall 3041. In this embodiment, the number of the electromagnetic elements 305 is three. Thus, PN is P3.

The spring 306 connects the end surface 302*c* with the terminal surface 304*c* to provide a force on the transmission rod 302 for it to return to a normal position.

Figure 5:
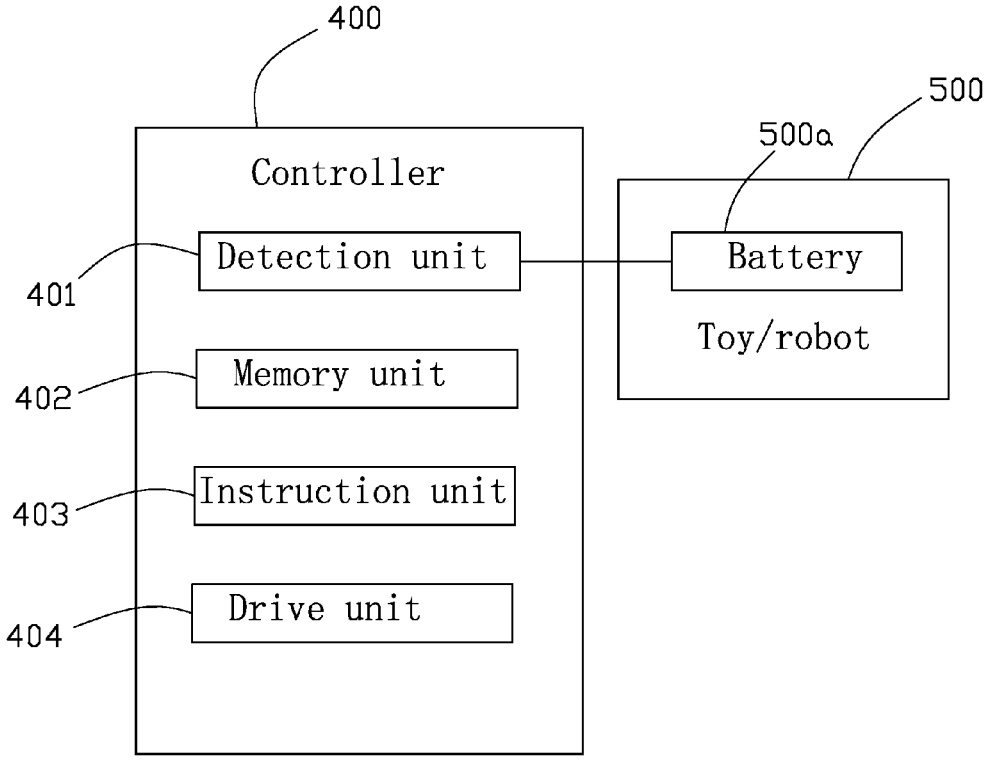
FIG. 5 is a block diagram of the artificial eye structure of FIG. 1.

Also referring to FIG. 5, the controller 400 is connected to the battery 500*a* of the toy/robot 500 and is configured for controlling a rotation angle of the artificial upper eyelid 200 according to remaining power of the battery 500*a*. The controller 400 includes a detection unit 401, a memory unit 402, an instruction unit 403, and a drive unit 404.

The detection unit 401 is configured for detecting the remaining power of the battery 500*a*.

The memory unit 402 is configured for storing a table. The table includes a collection of magnetizing instructions and a collection of remaining power ranges of the battery 500*a*, where each magnetizing instruction is associated with a corresponding remaining power range of the battery 500*a*. In this embodiment the range of the remaining power of the battery 500*a* is divided into three ranges: a low power level, an average power level, and a high power level, corresponding to the number of the electromagnetic members.

The instruction unit 403 is configured for determining which remaining power range of the battery 500*a* is in and reading the magnetizing instruction according to the remaining power level.

The drive unit 404 is configured for executing the magnetizing instruction to magnetize a corresponding electromagnetic element 305.

In assembly, the shaft 104 is rotatably supported by the shaft sleeves 108 via inserting the connecting ends 104*a*, 104*b* through the pivot holes 108*a* correspondingly so that the gear 106 is positioned above the sliding support 110.

The artificial upper eyelid 200 is connected to the shaft 104 by inserting the connecting ends 104*a*, 104*b* into the through holes 204 correspondingly. Then, the artificial upper eyelid 200 rotatably covers the artificial eyeball 100. The artificial lower eyelid 130 is integrally formed on the first outer surface 102 of the artificial eyeball 100 so that the short circular edges 133 correspondingly surround the connecting ears 202 and one of the long circular edges 132 of the artificial lower eyelid 130 is aligned with the edge 103 of artificial eyeball 100.

The transmission rod 302 is slidablely disposed on the sliding support 110 so that the bottom surface 302*b* is contacted with the holding surface 110*a* and the rack section 302*d* is meshed with the gear 106. The container 304 is fixed to a main body (not shown) of the toy/robot 500. The transmission rod 302 inserts into the container 304. The permanent magnet 307 is fixed on the bottom surface 302*b* and positioned in the effect range of the electromagnetic elements 305. The controller 400 is electrical connected to the electromagnetic elements 305 for controlling the rotation of the artificial upper eyelid 200 by selectively magnetizing the electromagnetic elements 305.

In use, the detection unit 401 detects the remaining power of the battery 500*a*. The instruction unit 403 determines which range the detected remaining power of the battery 500*a* falls in and reads the magnetizing instruction in the table. The drive unit 404 magnetizes the specified electromagnetic element 305 according to the magnetizing instruction read by the instruction unit 403. The magnetized electromagnetic element 305 attracts the permanent magnet 307 fixed on the bottom surface 302*b* and drives the transmission rod 302 to slide on the sliding support 110. The transmission rod 302 drives the shaft 104 to rotate, utilizing the engagement between the gear 106 and the rack section 302*d* formed on the upper surface 302*a*. The artificial upper eyelid 200 rotates with the shaft 104 to a corresponding position. Therefore, the artificial upper eyelid 200 can rotate to different positiones according to the remaining power value of the battery 500*a* for simulating different states of a person: excited, alert, and tiresome.

It's understood that each of the electromagnetic elements 305 corresponds to a specified rotation position of the artificial upper eyelid 200. Therefore, the number of the electromagnetic elements 305 is determined by the number of the specified rotation positions where the artificial upper eyelid 200 is designed to rotate to.

The artificial eye structure 10 uses magnetism to drive the artificial upper eyelid 200 to rotate. The rotation position of the artificial upper eyelid 200 can be controlled by manipulating the electromagnetic elements 305. Therefore, the artificial eye structure 10 can work more quietly and the artificial upper eyelid 200 can rotate according to the remaining power of the battery 500*a* of the toy/robot 500 for simulating the different state of human being more vivid.

While certain embodiments have been described and exemplified above, various other embodiments will be apparent to those skilled in the art from the foregoing disclosure. The present invention is not limited to the particular embodiments described and exemplified but is capable of considerable variation and modification without departure from the scope of the appended claims.

What is claimed is:

1. An artificial eye structure, comprising:

an artificial eyeball being a hollow semi-sphere in shape and comprising a circular edge, a first outer surface, a pupil pattern formed on the first outer surface, and a pair of shaft sleeves correspondingly formed at the edge, the shaft sleeves being aligned with each other;

a shaft rotatablely connected to the shaft sleeves;

an artificial upper eyelid connected to the shaft and configured to rotate with the shaft;

a gear sleeved on the shaft;

a transmission rod comprising a teethed rack section meshed with the gear;

a drive device comprising a plurality of electromagnetic elements disposed along a line, and a magnet fixed on the transmission rod; and a controller electrically connected to the electromagnetic elements for selectively magnetizing the electromagnetic elements, the magnetized electromagnetic element attracting the magnet and driving the transmission rod to move along the line of the electromagnetic elements and driving the shaft to rotate via the gear, the artificial upper eyelid rotating with the shaft to cover and uncover the pupil pattern.

2. The artificial eye structure as claimed in claim 1, wherein each of the shaft sleeves defines a pivot hole therethrough, the pivot holes are aligned with each other and defined a pivot axis therethrough; the artificial eyeball further comprises a first inner surface and a sliding support, the sliding support extends from the first inner surface beneath one of the shaft sleeves and comprises a holding surface parallel to the pivot axis; the transmission rod comprises an upper surface, a bottom surface opposite to the upper surface, an end surface perpendicularly connecting to one end of the upper surface and a corresponding end of the bottom surface, the rack section is formed on the upper surface, and the transmission rod is slidablely disposed on the sliding support with the bottom surface contacting with the holding surface.

3. The artificial eye structure as claimed in claim 2, wherein the drive device comprises a container, the container comprises a rectangular tube and an end wall sealing one end of the rectangular tube, the rectangular tube comprises an inner bottom surface parallel to the bottom surface of the transmission rod, the end wall comprises a second inner surface perpendicular to the inner bottom surface; the electromagnetic elements are disposed on the inner bottom surface substantially along the length of the rectangular tube from the second inner surface to the end of the rectangular tube away from the end wall; the artificial eye structure further comprises a spring connecting the end surface with the second inner surface.

4. The artificial eye structure as claimed in claim 2, wherein the artificial upper eyelid comprises a pair of circular edges, and a pair of connecting portions extending from the intersection of the circular edges and defining a through hole at the centre thereof; the shaft comprises two opposite connecting ends, the shaft is rotatablely connected to the shaft sleeves via the connecting ends correspondingly passing through the pivot holes, and the artificial upper eyelid is connected to the shaft via the through holes fixing to the connecting ends correspondingly.

5. The artificial eye structure as claimed in claim 1, further comprising a lower eyelid and a support portion, the lower eyelid comprises a second outer surface, a pair of long circular edges, and a pair of short circular edges formed at the intersection of the long circular edges, the artificial lower eyelid is integrally formed on the first outer surface with the short circular edges correspondingly aligned with the shaft sleeves and one of the long circular edges aligned with the circular edge, and the support portion is extended from the second outer surface for fixing the artificial eye structure onto a device utilizing the artificial eye structure.

6. A toy comprising:

an artificial eye structure comprising:

an artificial eyeball being a hollow semi-sphere in shape and comprising a circular edge, a first outer surface, a pupil pattern formed on the first outer surface, and a pair of shaft sleeves correspondingly formed at the edge, the shaft sleeves being aligned with each other;

an artificial upper eyelid rotatablely connected to the artificial eyeball;

a transmission device comprising:

a shaft rotatably connected to the shaft sleeves;

a gear sleeved on the shaft; and a transmission rod comprising a teethed rack section meshed with the gear;

a drive device comprising a plurality of electromagnetic elements disposed along a line, and a magnet fixed on the transmission rod; and a controller electrically connected to the electromagnetic elements to selectively magnetize the electromagnetic elements according to the remaining power of a battery used by the toy, the electromagnetic element once magnetized attracting the magnet and driving the transmission rod to move towards the electromagnetic elements and driving the shaft to rotate via the gear, the artificial upper eyelid rotating with the shaft to cover and uncover the pupil pattern.

7. The toy as claimed in claim 6, wherein the controller comprises:

a detection unit configured for detecting the remaining power of the battery;

a memory unit configured for storing a table comprising a collection of magnetizing instructions and a collection of ranges of remaining power of the battery, where each magnetizing instruction is associated with a corresponding range of remaining power of the battery;

an instruction unit configured for determining which range the detected remaining power of the battery falls in and reading the corresponding magnetizing instruction; and a drive unit configured for executing the read magnetizing instruction to magnetize a corresponding electromagnetic element.

8. The toy as claimed in claim 6, wherein each of the shaft sleeves defines a pivot hole therethrough, the pivot holes are aligned with each other and defined a pivot axis therethrough; the artificial eyeball further comprises a first inner surface and a sliding support, the sliding support extends from the first inner surface beneath one of the shaft sleeves and comprises a holding surface parallel to the pivot axis; the transmission rod comprises an upper surface, a bottom surface opposite to the upper surface, an end surface perpendicularly connecting to one end of the upper surface and a corresponding end of the bottom surface, the rack section is formed on the upper surface, and the transmission rod is slidablely disposed on the sliding support with the bottom surface contacting with the holding surface.

9. The toy as claimed in claim 8, wherein the drive device comprises a container, the container comprises a rectangular tube and an end wall sealing one end of the rectangular tube, the rectangular tube comprises an inner bottom surface parallel to the bottom surface of the transmission rod, the end wall comprises a second inner surface perpendicular to the inner bottom surface; the electromagnetic elements are disposed on the inner bottom surface substantially along the length of the rectangular tube from the second inner surface to the end of the rectangular tube away from the end wall; and the artificial eye structure further comprises a spring connecting the end surface with the second inner surface.

10. The toy as claimed in claim 8, wherein the artificial upper eyelid comprises a pair of circular edges, and a pair of connecting portions extending from the intersection of the circular edges and defining a through hole at the centre thereof; the shaft comprises two opposite connecting ends, the shaft is rotatablely connected to the shaft sleeves via the connecting ends correspondingly passing through the pivot holes; and the artificial upper eyelid is connected to the shaft via the through holes fixing to the connecting ends correspondingly.

11. The toy as claimed in claim 6, further comprising a lower eyelid and a support portion, the lower eyelid comprising a second outer surface, a pair of long circular edges, and a pair of short circular edges formed at the intersection of the long circular edges, the artificial lower eyelid being integrally formed on the first outer surface with the short circular edges corresponding aligned with the shaft sleeves and one of the long circular edges aligned with the circular edge, the support portion being extended from the second outer surface for fixing the artificial eye structure onto a device utilizing the artificial eye structure.

* * * * *